US010443926B2

(12) United States Patent
Ohart et al.

(10) Patent No.: US 10,443,926 B2
(45) Date of Patent: Oct. 15, 2019

(54) SYSTEM AND METHOD FOR LIQUEFIED NATURAL GAS PRODUCTION

(71) Applicants: Daniel Ohart, Waverly, NY (US); Greg Yonker, Lawrenceville, GA (US); Jason M. Kerth, Houston, TX (US)

(72) Inventors: Daniel Ohart, Waverly, NY (US); Greg Yonker, Lawrenceville, GA (US); Jason M. Kerth, Houston, TX (US)

(73) Assignee: DRESSER-RAND COMPANY, Olean, NY (US)

( * ) Notice: Subject to any disclaimer, the term of this patent is extended or adjusted under 35 U.S.C. 154(b) by 640 days.

(21) Appl. No.: 14/924,788

(22) Filed: Oct. 28, 2015

(65) Prior Publication Data

US 2016/0138861 A1 May 19, 2016

Related U.S. Application Data

(60) Provisional application No. 62/081,799, filed on Nov. 19, 2014, provisional application No. 62/246,171, filed on Oct. 26, 2015.

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/005* (2013.01); *F25J 1/0045* (2013.01); *F25J 1/0052* (2013.01); *F25J 1/0087* (2013.01); *F25J 1/023* (2013.01); *F25J 1/0208* (2013.01); *F25J 1/0227* (2013.01); *F25J 1/0264* (2013.01); *F25J 1/0265* (2013.01); *F25J 1/0268* (2013.01); *F25J 1/0284* (2013.01); *F25J 1/0288* (2013.01); *F25J 2210/06* (2013.01); *F25J 2230/30* (2013.01); *F25J 2270/12* (2013.01); *F25J 2270/60* (2013.01); *F25J 2270/90* (2013.01); *F25J 2270/906* (2013.01)

(58) Field of Classification Search
CPC ..... F25J 1/0037; F25J 1/0221–1/0222; F25J 1/0224; F25J 2270/88; F25J 1/0092; F25J 1/0212; F25J 2270/66
See application file for complete search history.

(56) References Cited

U.S. PATENT DOCUMENTS

| | | | | |
|---|---|---|---|---|
| 6,250,105 | B1 * | 6/2001 | Kimble | F25J 1/0022 62/613 |
| 6,324,867 | B1 | 12/2001 | Fanning et al. | |
| 7,967,036 | B2 | 6/2011 | Ding et al. | |
| 8,549,877 | B2 | 10/2013 | Santos | |
| 2007/0193303 | A1 | 8/2007 | Hawrysz et al. | |
| 2010/0154470 | A1 | 6/2010 | Nilsen | |

(Continued)

FOREIGN PATENT DOCUMENTS

WO 2009061777 A1 5/2009

*Primary Examiner* — Tareq Alosh

(57) ABSTRACT

A system and method for producing liquefied natural gas from a natural gas source is provided. The method may include feeding natural gas provided by the natural gas source to a liquefaction module. The method may also include flowing the natural gas through a product stream of the liquefaction module. The method may further include flowing a process fluid through a liquefaction stream of the liquefaction module to cool at least a portion of the natural gas flowing through the product stream to produce the liquefied natural gas.

6 Claims, 5 Drawing Sheets

(56) References Cited

U.S. PATENT DOCUMENTS

| | | | | |
|---|---|---|---|---|
| 2011/0094261 | A1* | 4/2011 | Wilding | F25J 1/0022 62/611 |
| 2012/0036888 | A1* | 2/2012 | Vandor | F25J 1/0022 62/613 |
| 2012/0279235 | A1 | 11/2012 | Santos | |
| 2013/0263624 | A1 | 10/2013 | Vandor | |
| 2015/0153100 | A1* | 6/2015 | Zia | F25J 1/0022 62/6 |

* cited by examiner

SYSTEM AND METHOD FOR LIQUEFIED NATURAL GAS PRODUCTION

This application claims the benefit of U.S. Provisional Patent Application having Ser. No. 62/081,799, which was filed Nov. 19, 2014 and of U.S. Provisional Patent Application having Ser. No. 62/246,171, which was filed Oct. 26, 2015. The aforementioned patent applications are hereby incorporated by reference in their entirety into the present application to the extent consistent with the present application.

BACKGROUND

The combustion of conventional fuels, such as gasoline and diesel, has proven to be essential in a myriad of industrial processes. The combustion of gasoline and diesel, however, may often be accompanied by various drawbacks including increased production costs and increased carbon emissions. In view of the foregoing, recent efforts have focused on alternative fuels with decreased carbon emissions, such as natural gas, to combat the drawbacks of combusting conventional fuels. In addition to providing a "cleaner" alternative fuel with decreased carbon emissions, combusting natural gas may also be relatively safer than combusting conventional fuels. For example, the relatively low density of natural gas allows it to safely and readily dissipate to the atmosphere in the event of a leak. In contrast, conventional fuels (e.g., gasoline and diesel) have a relatively high density and tend to settle or accumulate in the event of a leak, which may present a hazardous and potentially fatal working environment for nearby operators.

While utilizing natural gas may address some of the drawbacks of conventional fuels, the storage and transport of natural gas often prevent it from being viewed as a viable alternative to conventional fuels. Accordingly, natural gas is routinely converted into liquefied natural gas (LNG) at LNG plants and transported from the LNG plants to the customers via tankers. The availability of the LNG, however, may often be limited by the proximity of the customers to the LNG plants. For example, customers that are remotely located from the LNG plants may often rely on deliveries from the tankers, which may increase the cost of utilizing the LNG. Additionally, remotely located customers may often be required to maintain larger, cost-prohibitive storage tanks to reduce the frequency of the deliveries and/or their dependence on the tankers.

In view of the foregoing, small scale LNG plants have been developed to produce the LNG at pressure letdown stations. The utility of the small scale LNG plants, however, may often be limited to pressure letdown stations having a relatively high pressure natural gas source. Further, the variability in the properties (e.g., temperature, pressure, purity, etc.) of the natural gas available at each of the pressure letdown stations may make the designing, engineering, and manufacturing of the small scale LNG plants cost-prohibitive and/or impractical.

What is needed, then, is a system and method for producing liquefied natural gas from a wide variety of natural gas sources.

SUMMARY

Embodiments of the disclosure may provide a method for producing liquefied natural gas from a natural gas source. The method may include feeding natural gas provided by the natural gas source to a liquefaction module. The method may also include flowing the natural gas through a product stream of the liquefaction module. The method may further include flowing a process fluid through a liquefaction stream of the liquefaction module to cool at least a portion of the natural gas flowing through the product stream to produce the liquefied natural gas.

Embodiments of the disclosure may also provide another method for producing liquefied natural gas from a natural gas source. The method may include compressing natural gas provided from the natural gas source in a precompression module. The method may also include removing at least a portion of a non-hydrocarbon from the natural gas in a conditioning module fluidly coupled with the precompression module. The method may further include feeding the natural gas from the conditioning module to a liquefaction module, and flowing the natural gas through a product stream of the liquefaction module. The method may also include flowing a process fluid through a liquefaction stream of the liquefaction module to cool at least a portion of the natural gas flowing through the product stream to produce the liquefied natural gas.

Embodiments of the disclosure may further provide a system for producing liquefied natural gas from a natural gas source. The system may include a liquefaction module, a precompression module, a conditioning module, a power generation module, and a storage tank. The liquefaction module may be configured to receive compressed natural gas at a predetermined pressure and cool at least a portion of the compressed natural gas to the liquefied natural gas. The precompression module may be configured to receive natural gas from the natural gas source and compress the natural gas to the predetermined pressure of the liquefaction module. The conditioning module may be fluidly coupled with the precompression module and the liquefaction module, and configured to receive the compressed natural gas from the precompression module, remove at least a portion of a non-hydrocarbon from the compressed natural gas, and feed the compressed natural gas to the liquefaction module. The power generation module may be operably coupled with the liquefaction module and fluidly coupled with the conditioning module. The power generation module may be configured to receive and combust at least a portion of the non-hydrocarbon from the conditioning module to generate electrical energy, and delivery the electrical energy to the liquefaction module. The storage tank may be fluidly coupled with the liquefaction module and configured to receive and store the liquefied natural gas from the liquefaction module.

Embodiments of the disclosure may further provide another system for producing liquefied natural gas from a natural gas source. The system may include a liquefaction module, a precompression module, a conditioning module, a power generation module, and a storage tank. The liquefaction module may be configured to receive compressed natural gas at a predetermined pressure and cool at least a portion of the compressed natural gas to the liquefied natural gas. The precompression module may be configured to receive natural gas from the natural gas source and compress the natural gas to the predetermined pressure of the liquefaction module. The conditioning module may be fluidly coupled with the precompression module and the liquefaction module, and configured to receive the compressed natural gas from the precompression module, remove at least a portion of a non-hydrocarbon from the compressed natural gas, and feed the compressed natural gas to the liquefaction module. The power generation module may be operably coupled with the liquefaction module and fluidly coupled with the conditioning module. The power generation module may be configured to receive and combust at least a portion of the non-hydrocarbon from the conditioning module to generate electrical energy, and delivery the electrical energy to the liquefaction module. The storage tank may be fluidly coupled with the liquefaction module and configured to receive and store the liquefied natural gas from the liquefaction module. The liquefaction module may include a first heat exchanger fluidly coupled with and disposed downstream from an inlet of the liquefaction module and configured to receive and cool the compressed natural gas therefrom. The liquefaction module may also include a first expansion valve fluidly coupled with and disposed downstream from the first heat exchanger. The first expansion valve may be configured to expand a first portion of the cooled compressed natural gas from the first heat exchanger. The liquefaction module may further include a second heat exchanger fluidly coupled with and disposed downstream from the first heat exchanger via a first line and via a first line, and further disposed downstream from the first expansion valve via a second line. The second heat exchanger may be configured to receive and cool a second portion of the cooled compressed natural gas from the first heat exchanger with the expanded first portion of the cooled compressed natural gas from the first expansion valve. The liquefaction module may also include a second expansion valve fluidly coupled with and disposed downstream from the second heat exchanger, and a liquid separator fluidly coupled with and disposed downstream from the second expansion valve. The second expansion valve may be configured to expand the second portion of the cooled compressed natural gas from the second heat exchanger to produce a two-phase fluid including the liquefied natural gas and a vapor phase. The liquid separator may be configured to separate the liquefied natural gas from the vapor phase.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
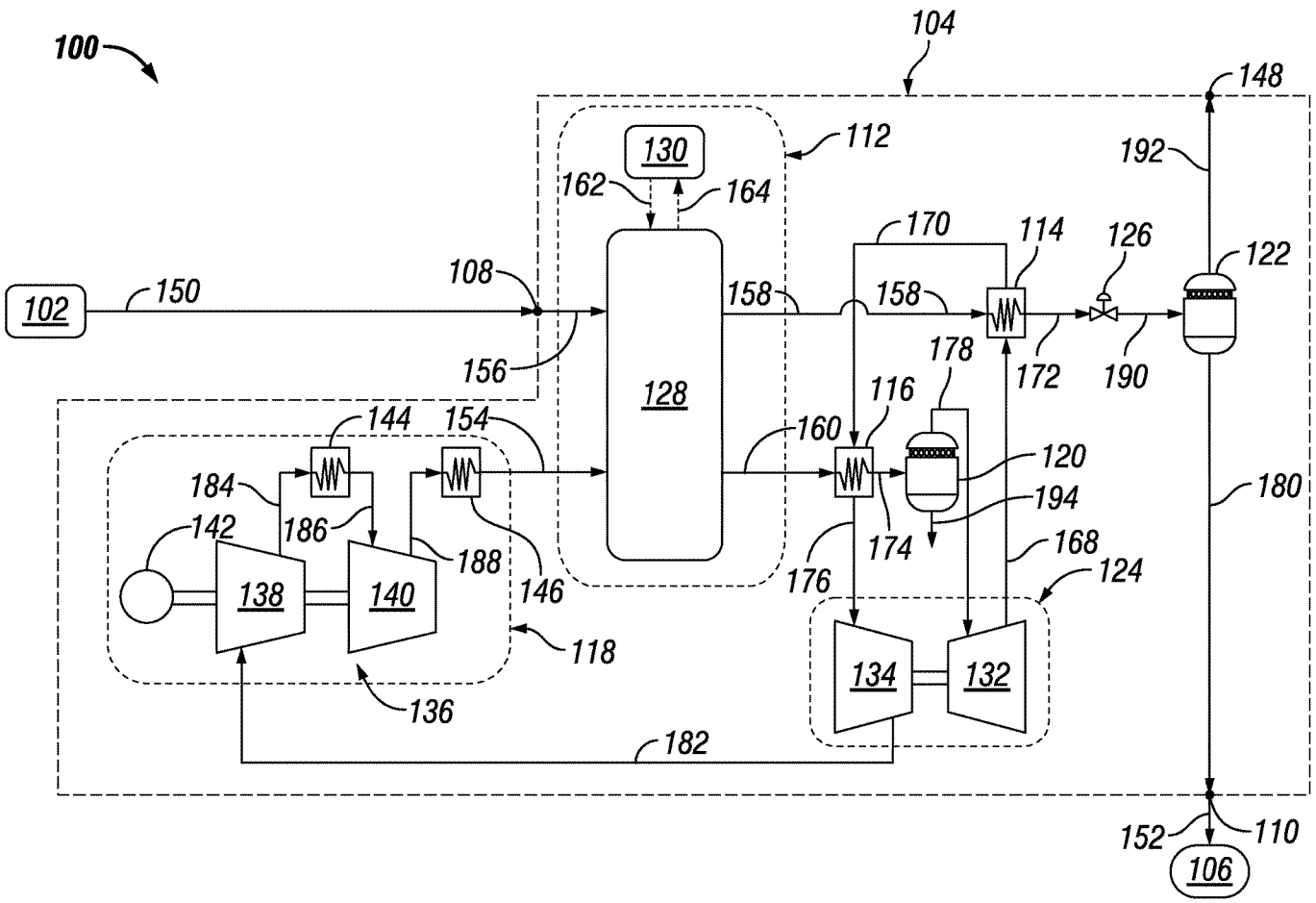
FIG. 1 illustrates a process flow diagram of an exemplary system for producing liquefied natural gas from a natural gas source, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a process flow diagram of an exemplary system 100 for producing liquefied natural gas (LNG) from a natural gas source 102, according to one or more embodiments. The system 100 may include a liquefaction module 104 fluidly coupled with the natural gas source 102 and a storage tank 106. For example, as illustrated in FIG. 1, the liquefaction module 104 may have an inlet 108 fluidly coupled with the natural gas source 102 via line 150 and an outlet 110 fluidly coupled with the storage tank 106 via line 152. The liquefaction module 104 may be configured to receive a process fluid containing natural gas via the inlet 108 thereof, compress and/or cool at least a portion of the natural gas contained in the process fluid to LNG, and discharge the LNG to the storage tank 106 via the outlet 110 thereof.

The natural gas source 102 may be or include a natural gas pipeline, a stranded natural gas wellhead, or the like, or any combination thereof. The natural gas source 102 may contain natural gas at ambient temperature. The natural gas source 102 may also contain natural gas at a relatively high pressure (e.g., about 3,400 kPa to about 8,400 kPa or greater) or a relatively low pressure (e.g., about 100 kPa to about 3,400 kPa). For example, the natural gas source 102 may be a high pressure natural gas pipeline containing natural gas at a pressure from about 3,400 kPa, about 3,900 kPa, about 4,400 kPa, about 4,900 kPa, or about 5,400 kPa to about 5,900 kPa, about 6,400 kPa, about 6,900 kPa, about 7,400 kPa, about 7,900 kPa, about 8,400 kPa, or greater. In another example, the natural gas source 102 may be a low pressure natural gas pipeline containing natural gas at a pressure from about 100 kPa, about 150 kPa, about 300 kPa, about 400 kPa, or about 500 kPa to about 1,000 kPa, about 1,500 kPa, about 2,000 kPa, about 2,500 kPa, about 3,000 kPa, or about 3,500 kPa.

The natural gas from the natural gas source 102 may include one or more hydrocarbons. For example, the natural gas may include methane, ethane, propane, butanes, pentanes, or the like, or any combination thereof. Methane may be a major component of the natural gas. For example, the concentration of methane in the natural gas may be greater than about 80%, greater than about 85%, greater than about 90%, or greater than about 95%. The natural gas may also include one or more non-hydrocarbons. For example, the natural gas may be or include a mixture of one or more hydrocarbons and one or more non-hydrocarbons. Illustrative non-hydrocarbons may include, but are not limited to, water, carbon dioxide, hydrogen sulfide, helium, nitrogen, or the like, or any combination thereof.

The storage tank 106 may be configured to receive and store the LNG produced in the system 100. For example, as illustrated in FIG. 1, the storage tank 106 may be fluidly coupled with and disposed downstream from the outlet via line 152 and configured to receive and store a liquid phase or the LNG therefrom. The storage tank 106 may be or include any container capable of storing the LNG. Illustrative storage tanks may include, but are not limited to, cryogenic storage tanks, vessels, a Dewar-type vessel, or any other container capable of storing the LNG. The storage tank 106 may be configured to store the natural gas at a designed storage pressure. In an exemplary embodiment, the designed storage pressure of the storage tank 106 may be from about 100 kPa, about 150 kPa, about 175 kPa, or about 190 kPa to about 210 kPa, about 225 kPa, about 250 kPa, about 300 kPa, or greater. For example, the designed storage pressure of the storage tank 106 may be from about 100 kPa to about 300 kPa, about 150 kPa to about 250 kPa, about 175 kPa to about 225 kPa, or about 190 kPa to about 210 kPa. In at least one embodiment, the storage tank 106 may have a maximum storage pressure or a maximum allowable working pressure (MAWP) rating. The MAWP of the storage tank 106 may be greater than about 250 kPa, greater than about 300 kPa, greater than about 350 kPa, greater than about 400 kPa, greater than about 500 kPa, or greater than about 600 kPa.

The liquefaction module 104 may include a cooling assembly 112, one or more heat exchangers (two are shown 114, 116), a compression assembly 118, one or more liquid separators (two are shown 120, 122), a turbo-expander 124, an expansion valve 126, or any combination thereof, fluidly, communicably, and/or operatively coupled with one another. For example, as illustrated in FIG. 1, the cooling assembly 112 may be fluidly coupled with and disposed downstream from the compression assembly 118 and the inlet 108 via line 154 and line 156, respectively. The cooling assembly 112 may also be fluidly coupled with and disposed upstream of the heat exchangers 114, 116. For example, as illustrated in FIG. 1, the cooling assembly 112 may be fluidly coupled with and disposed upstream of a first heat exchanger 114 and a second heat exchanger 116 via line 158 and line 160, respectively.

The cooling assembly 112 may include one or more heat exchangers or pre-cooling heat exchangers (one is shown 128) and one or more chillers (one is shown 130) thermally, operatively, and/or fluidly coupled with one another. For example, as illustrated in FIG. 1, the pre-cooling heat exchanger 128 may be fluidly coupled with the chiller 130 via a cooling line 162 and a return line 164. The pre-cooling heat exchanger 128 may be configured to cool or remove at least a portion of the heat from the process fluid flowing therethrough. For example, the pre-cooling heat exchanger 128 may be configured to receive a process fluid, such as a refrigerant, from the chiller 130 via the cooling line 162, and transfer the heat from the process fluid flowing therethrough to the refrigerant to thereby cool the process fluid and/or the natural gas contained therein. The heated refrigerant from the pre-cooling heat exchanger 128 may then be directed back to the chiller 130 via the return line 164 and subsequently cooled therein.

In at least one embodiment, the chiller 130 may be or include a vapor absorption chiller or non-mechanical chiller configured to receive and be driven by heat (e.g., waste heat, solar heat, etc.). Illustrative non-mechanical chillers may include, but are not limited to, ammonia absorption chillers, lithium bromide absorption chillers, and the like. In another embodiment, the chiller 130 may be a vapor compression chiller or mechanical chiller configured to receive and be driven by electrical energy. For example, the chiller 130 may be a mechanical chiller operatively coupled with a power generation system 202 (see FIG. 2) and configured to receive and be driven by electrical energy from the power generation system 202. The mechanical chiller may include a compressor (not shown) and an electric motor (not shown) configured to drive the compressor. Accordingly, in an exemplary embodiment, no heat (e.g., waste heat) may be used to drive or operate the mechanical chiller. Utilizing the mechanical chiller may provide a relatively higher coefficient of performance as compared to the non-mechanical chiller. Illustrative mechanical chillers may include, but are not limited to, ammonia-based mechanical chillers, propane-based ammonia chillers, propane-based mechanical chiller, and the like. It may be appreciated that the propane-based mechanical chiller may be capable of cooling the refrigerant to a relatively lower temperature than the ammonia-based mechanical chillers.

The first and second heat exchangers 114, 116 may be fluidly coupled with and disposed downstream from the pre-cooling heat exchanger 128 of the cooling assembly 112. Each of the first and second heat exchangers 114, 116 may be configured to receive a process fluid from the pre-cooling heat exchanger 128 and cool or remove at least a portion of the heat from the process fluid. The first and second heat exchangers 114, 116 may be or include any device capable of at least partially cooling or reducing the temperature of the process fluid flowing therethrough. Illustrative heat exchangers may include, but are not limited to, a direct contact heat exchanger, a cooler, a trim cooler, a mechanical refrigeration unit, a welded plate heat exchanger, or the like, or any combination thereof.

As illustrated in FIG. 1, the first heat exchanger 114 may be fluidly coupled with and disposed downstream from the pre-cooling heat exchanger 128 and the turbo-expander 124 via line 158 and line 168, respectively. The first heat exchanger 114 may also be fluidly coupled with and disposed upstream of the second heat exchanger 116 and the expansion valve 126 via line 170 and line 172, respectively. The first heat exchanger 114 may be configured to receive the cooled process fluid from the pre-cooling heat exchanger 128, further cool the cooled process fluid, and direct the further cooled process fluid to the expansion valve 126. For example, the first heat exchanger 114 may receive a refrigeration stream from the turbo-expander 124 via line 168, transfer heat from the cooled process fluid to the refrigeration stream to further cool the cooled process fluid, and direct the further cooled process fluid to the expansion valve 126 via line 172. The refrigeration stream from the first heat exchanger 114 may then be directed to the second heat exchanger 116 via line 170 to cool the process fluid flowing therethrough.

The second heat exchanger 116 may be fluidly coupled with and disposed upstream of a first liquid separator 120 and the turbo-expander 124 via line 174 and line 176, respectively. The second heat exchanger 116 may be configured to receive the cooled process fluid from the pre-cooling heat exchanger 128, further cool the cooled process fluid, and direct the further cooled process fluid to the first liquid separator 120. For example, the second heat exchanger 116 may receive the refrigeration stream from the first heat exchanger 114 via line 170, transfer heat from the cooled process fluid to the refrigeration stream to further cool the cooled process fluid, and direct the further cooled process fluid to the first liquid separator 120 via line 174. As further described herein, the heated or "spent" refrigeration stream from the second heat exchanger 116 may be directed to the turbo-expander 124 via line 176 and subsequently compressed therein.

The expansion valve 126 may be fluidly coupled with and disposed upstream of a second liquid separator 122 via line 190. The expansion valve 126 may be configured to receive the process fluid from the first heat exchanger 114 and expand the process fluid to thereby decrease a temperature and pressure thereof. As further described herein, the expansion of the process fluid through the expansion valve 126 may flash the process fluid into a two-phase fluid including a gaseous or vapor phase and a liquid phase (e.g., the LNG). In an exemplary embodiment, the expansion valve 126 may be a Joule-Thomson (JT) valve.

As illustrated in FIG. 1, the first liquid separator 120 may be fluidly coupled with and disposed upstream of the turbo-expander 124 via line 178, and the second liquid separator 122 may be fluidly coupled with and disposed upstream of the outlet 110 via line 180. The first and second liquid separators 120, 122 may be configured to remove or separate at least a portion of a liquid phase (e.g., natural gas liquids and/or the LNG) from the process fluid flowing therethrough. For example, as further described herein, the first separator 120 and/or the second liquid separator 122 may be configured to separate a liquid phase containing relatively high molecular weight hydrocarbons (e.g., NGLs) from a vapor phase. In another example, the first separator 120 and/or the second liquid separator 122 may be configured to separate a liquid phase containing the LNG from a vapor phase. Illustrative liquid separators may include, but are not limited to, scrubbers, liquid-gas separators, rotating separators, stationary separators, or the like.

The turbo-expander 124 of the core-module 104 may include a turbine 132 and a compressor 134 operably coupled with one another. For example, as illustrated in FIG. 1, the turbine 132 and the compressor 134 may be coupled with one another via a rotary shaft. The turbine 132 may be configured to receive the process fluid from the first liquid separator 120 via line 178 and expand the process fluid to produce a refrigeration stream. For example, the turbine 132 may expand the process fluid from the first liquid separator 120 to decrease a temperature and pressure thereof and produce the refrigeration stream. As previously discussed, the refrigeration stream may be directed to the first heat exchanger 114 via line 168 to cool the process fluid flowing therethrough. The turbine 132 may also be configured to convert a pressure drop from the expansion of the process fluid to mechanical energy. The mechanical energy provided or generated by the turbine 132 may be utilized to drive the compressor 134 via the rotary shaft.

The compressor 134 of the turbo-expander 124 may be fluidly coupled with and disposed downstream from the second heat exchanger 116 via line 176. The compressor 134 may be configured to utilize the mechanical energy from the turbine 132 to compress the process fluid flowing therethrough. For example, the compressor 134 may be configured to receive and compress a process fluid containing the heated or "spent" refrigeration stream from the second heat exchanger 116. The compression of the process fluid through the compressor 134 may reduce the amount of energy utilized to compress the process fluid in the compression assembly 118. For example, the compressor 134 may be fluidly coupled with and disposed upstream from the compression assembly 118 via line 182 and configured to deliver the compressed process fluid thereto.

The compression assembly 118 may include one or more compressors (one is shown 136) configured to compress and/or pressurize the process fluid directed thereto. Illustrative compressors may include, but are not limited to, supersonic compressors, centrifugal compressors, axial flow compressors, reciprocating compressors, rotating screw compressors, rotary vane compressors, scroll compressors, diaphragm compressors, or the like, or any combination thereof. The compressor 136 may include one or more compressor stages (two are shown 138, 140) and a driver 142 operatively coupled with and configured to drive the compressor stages 138, 140. For example, as illustrated in FIG. 1, the driver 142 may be coupled with and configured to drive a first compressor stage 138 and a second compressor stage 140 via a rotary shaft. Illustrative drivers 142 may include, but are not limited to, electric motors, turbines, internal combustion engines, and/or any other devices capable of driving the compressor 136 or the compressor stages 138, 140 thereof. In an exemplary embodiment, the driver 142 may be an electric motor configured to receive and be driven by electrical energy.

As illustrated in FIG. 1, the compression assembly 118 may also include one or more heat exchangers or coolers (two are shown 144, 146) configured to absorb or remove heat from the process fluid flowing therethrough. The coolers 144, 146 may be fluidly coupled with and disposed downstream from the respective compressor stages 138, 140. For example, as illustrated in FIG. 1, a first cooler 144 may be fluidly coupled with and disposed downstream from the first compressor stage 138 via line 184, and a second cooler 146 may be fluidly coupled with and disposed downstream from the second compressor stage 140 via line 188. As further illustrated in FIG. 1, the first cooler 144 may be fluidly coupled with and disposed upstream of the second compressor stage via line 186. The first and second coolers 144, 146 may be configured to remove thermal energy or heat generated in the compressor stages 138, 140. For example, compressing the process fluid in the compressor stages 138, 140 may generate heat (e.g., heat of compression) in the process fluid, and the coolers 144, 146 may be configured to remove the heat of compression from the process fluid and/or the natural gas contained therein.

In at least one embodiment, a heat transfer medium may flow through each of the coolers 144, 146 to absorb the heat in the process fluid flowing therethrough. Accordingly, the heat transfer medium may have a higher temperature when it exits the coolers 144, 146 and the process fluid may have a lower temperature when it exits the coolers 144, 146. The heat transfer medium may be or include water, steam, a refrigerant, a process gas, such as carbon dioxide, air, propane, or natural gas, or the like, or any combination thereof. In an exemplary embodiment, the heat transfer medium may be or include a refrigerant from the chiller 130 of the cooling assembly 112. The heat transfer medium from the coolers 144, 146 may provide supplemental heating to one or more portions and/or assemblies of the system 100. For example, the heat transfer medium containing the heat absorbed from the coolers 144, 146 may provide supplemental heating to a heat recovery unit (HRU) (not shown).

In an exemplary operation, the liquefaction module 104 may be configured to receive a process fluid containing the natural gas in the gaseous phase at the inlet 108 thereof, direct or flow the process fluid containing the natural gas in the gaseous phase through a product stream to cool at least a portion of the natural gas in the process fluid to the LNG, and discharge or output the process fluid containing the LNG through the outlet 110 thereof. The liquefaction module 104 may be configured to receive the process fluid at the inlet 108 thereof at a predetermined inlet pressure. For example, the liquefaction module 104 may be configured to receive the process fluid at the inlet 108 thereof at a pressure of about 1,000 kPa to about 8,400 kPa. As further described herein, the inlet pressure and/or flow of the process fluid through the product stream may at least partially determine the amount of the LNG produced in the system 100. The liquefaction module 104 may also be configured to circulate or flow a process fluid containing natural gas through a liquefaction stream to cool at least a portion of the process fluid flowing through the product stream. As further described herein, the flow of the process fluid through one or more portions of the liquefaction stream may at least partially determine an amount or degree of cooling provided to the process fluid flowing through the product stream.

In the liquefaction stream, the process fluid containing the natural gas may be directed to the compression assembly 118 and subsequently compressed therein. For example, the process fluid may be directed to the first compressor stage 138 of the compressor 136 via line 182. The first compressor stage 138 may receive and compress the process fluid from line 182 and direct the compressed process fluid to the first cooler 144 via line 184. Compressing the recycle stream in the first compressor stage 138 may generate heat (e.g., the heat of compression) to thereby increase the temperature of the process fluid. Accordingly, the first cooler 144 may cool or remove at least a portion of the heat (e.g., the heat of compression) contained therein. The cooled process fluid from the first cooler 144 may be directed to the second compressor stage 140 via line 186. The second compressor stage 140 may compress the process fluid from the first cooler 144 and direct the compressed process fluid to the second cooler 146 via line 188. The second cooler 146 may cool the process fluid and direct the cooled process fluid to the pre-cooling heat exchanger 128 of the cooling assembly 112 via line 154.

The pre-cooling heat exchanger 128 may further cool the process fluid from the second cooler 146 and direct the further cooled process fluid to the second heat exchanger 116 via line 160. As previously discussed, the pre-cooling heat exchanger 128 may be configured to receive the refrigerant from the chiller 130 via the cooling line 162 and transfer heat from the process fluid flowing therethrough to the refrigerant to cool the process fluid and/or the natural gas contained therein. The second heat exchanger 116 may further cool the process fluid from the pre-cooling heat exchanger 128 and direct the process fluid to the first liquid separator 120 via line 174. The pre-cooling heat exchanger 128 and/or the second heat exchanger 116 may cool at least a portion of the natural gas contained in the process fluid to a liquid phase (e.g., natural gas liquids and/or the LNG). For example, as previously discussed, the natural gas in the process fluid may include a mixture of one or more hydrocarbons (e.g., methane, ethane, propane, butanes, pentanes, etc.), and the hydrocarbons having a relatively high molecular weight (e.g., ethane, propane, etc.) may be compressed, cooled, and/or otherwise condensed to the liquid phase before the hydrocarbons having a relatively low molecular weight (e.g., methane). The condensation of the hydrocarbons having the relatively high molecular weight may produce natural gas liquids (NGLs). The terms "natural gas liquids" or "NGLs" may refer to a liquid phase containing hydrocarbons having a relatively higher boiling point and/or a relatively lower vapor pressure than methane. The terms "natural gas liquids" or "NGLs" may also refer to a liquid phase containing hydrocarbons having a relatively higher molecular weight than methane.

The first liquid separator 120 may receive the process fluid from the second heat exchanger 116 via line 174, and remove or separate at least a portion of the NGLs from the process fluid to thereby provide a relatively drier process fluid. The NGLs separated from the process fluid may be directed to and stored in a storage tank (not shown) fluidly coupled with the first liquid separator 120 via line 194. The NGLs may be stored in the storage tank at a pressure and/or temperature equal or substantially equal to a pressure and/or temperature of the first liquid separator 120. Accordingly, a pump (not shown) may be fluidly coupled between the first liquid separator 120 and the storage tank and configured to transfer or pump the NGLs from the first liquid separator 120 to the storage tank.

The relatively drier process fluid from the first liquid separator 120 may be directed to the turbine 132 of the turbo-expander 124 via line 178. The turbine 132 may expand the process fluid from the first liquid separator 120 to decrease the temperature and pressure of the process fluid and thereby generate the refrigeration stream in line 168. The turbine 132 may have any expansion ratio. In an exemplary embodiment, the turbine 132 may have an expansion ratio of about 10:1. For example, the process fluid expanded through the turbine 132 may be subjected to a pressure reduction of about 10:1. The refrigeration stream from the turbine 132 may be directed to the first heat exchanger 114 via line 168 to absorb the heat from the process fluid flowing therethrough from line 158 to line 172.

In an exemplary embodiment, the refrigeration stream from the first heat exchanger 114 may provide additional cooling to one or more of the remaining heat exchangers of the system 100. For example, as illustrated in FIG. 1, the refrigeration stream from the first heat exchanger 114 may be directed to and through the second heat exchanger 116 from line 170 to line 176 to absorb the heat from the process fluid flowing through the second heat exchanger 116. The "spent" refrigeration stream from the second heat exchanger 116 may be directed to the compressor 134 of the turbo-expander 124 via line 176 and compressed therein.

The compressor 134 of the turbo-expander 124 may be configured to receive the refrigeration stream from the second heat exchanger 116, compress the refrigeration stream, and direct the compressed refrigeration stream to the compression assembly 118 as a recycle stream via line 182. In an exemplary embodiment, the compressor 134 may be configured to compress the refrigeration stream to a selected inlet pressure of one or more of the compressor stages 138, 140 of the compression assembly 118. For example, the compressor 134 may be configured to compress the refrigeration stream such that the recycle stream in line 182 may have a pressure equal or substantially equal to the selected inlet pressure of the first compressor stage 138. The selected inlet pressure of the compressor stages 138, 140 may be determined by one or more operating parameters of the liquefaction module 104 and/or the components and assemblies thereof. The first compressor stage 138 may receive the recycle stream from line 182 and direct the recycle stream through the liquefaction stream, as described above.

As previously discussed, the liquefaction module 104 may be configured to receive a process fluid containing the natural gas in the gaseous phase at the inlet 108 thereof, and direct or flow the process fluid containing the natural gas through the product stream to cool at least a portion of the natural gas in the process fluid to the LNG. In the product stream, the process fluid containing the natural gas in the gaseous phase may be directed from the inlet 108 to the pre-cooling heat exchanger 128 via line 156. The pre-cooling heat exchanger 128 may cool the process fluid from the inlet 108 and direct the cooled process fluid to the first heat exchanger 114 via line 158. As previously discussed, the pre-cooling heat exchanger 128 may receive the refrigerant from the chiller 130 via the cooling line 162 and transfer heat from the process fluid flowing therethrough to the refrigerant to cool the process fluid and the natural gas contained therein. The first heat exchanger 114 may further cool the process fluid from the pre-cooling heat exchanger 128 and direct the cooled process fluid to the expansion valve 126 via line 172. The refrigeration stream from the turbine 132 may be directed to the first heat exchanger 114 via line 168 to cool the process fluid flowing therethrough from line 158 to line 172.

The expansion valve 126 may receive the process fluid from the first heat exchanger 114 via line 172, expand the process fluid, and output the expanded process fluid to line 190. The expansion of the process fluid through the expansion valve 126 may decrease the temperature and pressure of the process fluid in line 190. The expansion valve 126 may decrease the process fluid to any pressure. For example, the expansion valve 126 may decrease the process fluid to a designed storage pressure of the storage tank 106. The expansion of the process fluid through the expansion valve 126 may also flash the process fluid into a two-phase fluid including a gaseous or vapor phase and a liquid phase. For example, the expansion of the process fluid through the expansion valve 126 may flash the process fluid into the two-phase fluid including the vapor phase and the liquid phase, or the LNG. In an exemplary embodiment, about 15% of the two-phase fluid in the process fluid may be in the vapor phase and about 85% of the two-phase fluid may be the LNG. The second liquid separator 122 may receive the two-phase fluid from line 190 and separate at least a portion of the LNG from the vapor phase. The LNG separated in the second liquid separator 122 may then be directed to the storage tank 106 via the outlet 110. For example, as illustrated in FIG. 1, the LNG separated in the second liquid separator 122 may be directed to the outlet 110 via line 180, and subsequently directed from the outlet 110 to the storage tank 106 via line 152. The vapor phase from the second liquid separator 122 may be discharged from the liquefaction module 104 via an outlet 148 thereof. For example, as illustrated in FIG. 1, the vapor phase from the second liquid separator 122 may be discharged to and through the outlet 148 via line 192. As further described herein with reference to FIG. 2, the vapor phase at the outlet 148 may be directed to a separate module for subsequent processing.

Figure 2:
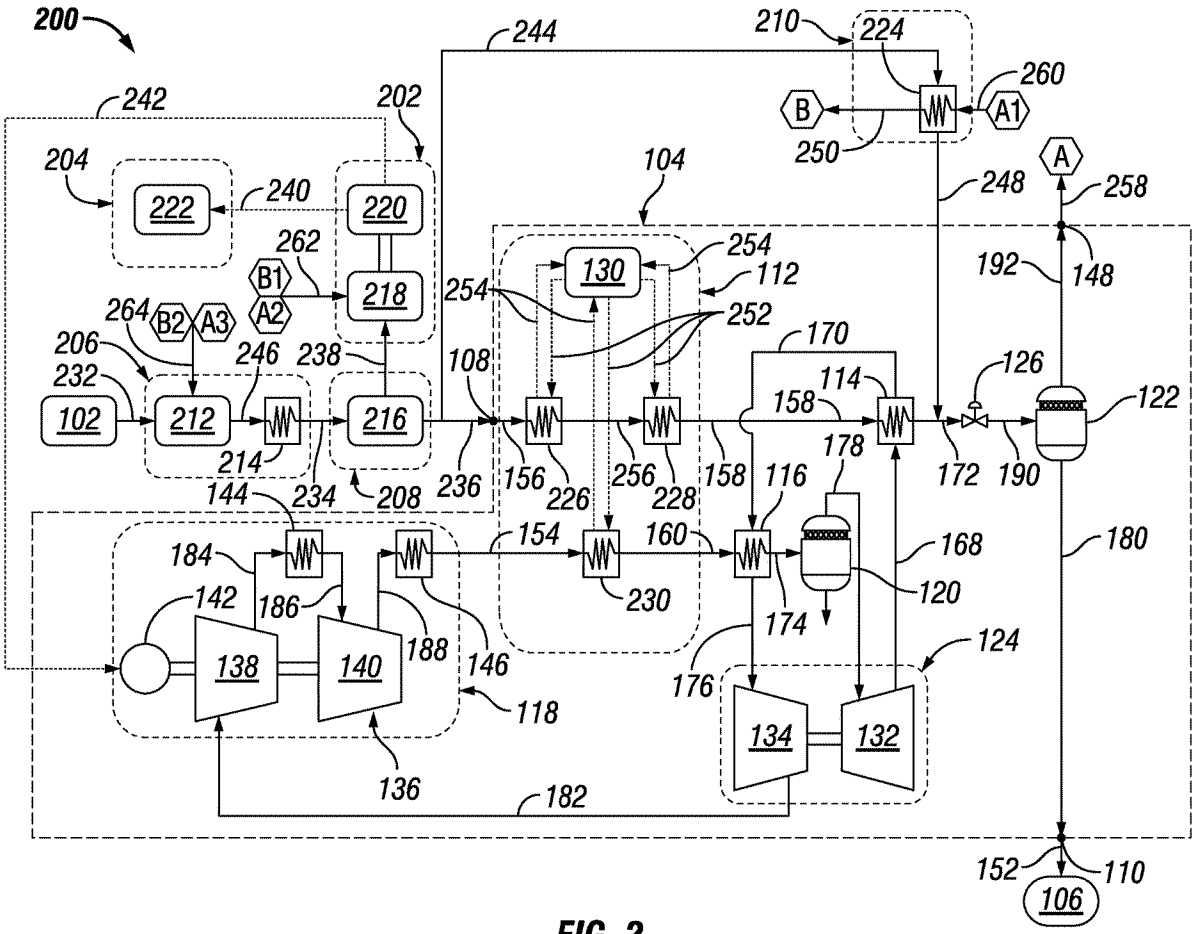
FIG. 2 illustrates a process flow diagram of another exemplary system for producing liquefied natural gas from a natural gas source, according to one or more embodiments disclosed.

FIG. 2 illustrates a process flow diagram of another exemplary system 200 for producing the LNG from the natural gas source 102, according to one or more embodiments. The system 200 illustrated in FIG. 2 may be similar in some respects to the system 100 described above and therefore may be best understood with reference to the description of FIG. 1, where like numerals designate like components and will not be described again in detail. The system 200 may include the liquefaction module 104 and one or more separate modules (five are shown 202, 204, 206, 208, 210). For example, the system 200 may include the liquefaction module 104, a power generation module 202, a control module 204, a precompression module 206, a conditioning module 208, a flash recovery module 210, or any combination thereof. As further described herein, the liquefaction module 104, the power generation module 202, the control module 204, the precompression module 206, the conditioning module 208, and/or the flash recovery module 210 may be fluidly and/or operatively coupled with one another.

As illustrated in FIG. 2, the precompression module 206 may be fluidly coupled with and disposed downstream from the natural gas source 102 via line 232, and may further be fluidly coupled with and disposed upstream of the preconditioning module 208 via line 234. The precompression module 206 may include one or more compressors (one is shown 212) and one or more coolers (one is shown 214) fluidly coupled with one another. For example, as illustrated in FIG. 2, the compressor 212 may be fluidly coupled with and disposed upstream of the cooler 214 via line 246. The compressor 212 may be configured to compress and/or pressurize the process fluid directed thereto via line 232, and the cooler 214 may be configured to absorb or remove heat from the process fluid flowing therethrough. The compressor 212 may be similar to the compressor 136 of the compression assembly 118. For example, the compressor 212 may include one or more compressor stages (not shown) and a driver (not shown) operatively coupled with and configured to drive the compressor stages via a rotary shaft (not shown). In an exemplary embodiment, the driver may be an electric motor configured to receive and be driven by electrical energy from the power generation module 202. The cooler 214 may be similar to any one of the coolers 144, 146 of the compression assembly 118. For example, the cooler 214 may be fluidly coupled with the compressor 212 and configured to remove heat generated in the compressor 212 (e.g., heat of compression).

The conditioning module 208 may be fluidly coupled with and disposed downstream from the precompression module 206 via line 234. The conditioning module 208 may also be fluidly coupled with and disposed upstream of the liquefaction module 104 and the power generation module 202 via line 236 and line 238, respectively. The conditioning module 208 may be configured to at least partially separate or remove one or more non-hydrocarbons from the natural gas contained in the process fluid flowing therethrough. For example, as previously discussed, the natural gas from the natural gas source 102 may be or include a mixture of one or more hydrocarbons (e.g., methane, ethane, etc.) and one or more non-hydrocarbons (e.g., water, carbon dioxide, hydrogen sulfide, etc.), and the conditioning module 208 may be configured to at least partially separate the non-hydrocarbons from the hydrocarbons.

The conditioning module 208 may include a separator 216 fluidly coupled with and disposed downstream from the precompression module 206 and/or the cooler 214 thereof, and configured to remove water and/or carbon dioxide from the natural gas in the process fluid flowing therethrough. The separator 216 may include or contain one or more adsorbents configured to separate the non-hydrocarbons. The adsorbents may include, but are not limited to, one or more molecular sieves, zeolites, metal-organic frameworks, or the like, or any combination thereof. The adsorbent, such as the molecular sieve, may be activated at varying temperatures and/or pressures. The adsorbent may have an adsorptive capacity determined by an amount of an adsorbate or the non-hydrocarbons separated by the adsorbent under predetermined conditions (e.g., temperature and/or pressure). In an exemplary embodiment, the separator 216 and/or the adsorbent contained therein may be configured to separate the non-hydrocarbons from the process fluid at a predetermined separation pressure and/or a predetermined separation temperature. For example, the separator 216 and/or the adsorbent may be configured to separate the non-hydrocarbons at a relatively high pressure (e.g., about 3,400 kPa to about 8,400 kPa or greater) or a relatively low pressure (e.g., about 1,000 kPa to about 3,400 kPa). In another example, the separator 216 and/or the adsorbent may be configured to separate the non-hydrocarbons from the process fluid at ambient temperature or at a temperature of about 10° C. to about 55° C. or greater.

As illustrated in FIG. 2, the power generation module 202 may be fluidly coupled with and disposed downstream from the conditioning module 208 via line 238. The power generation module 202 may be configured to generate electrical energy to drive one or more components or assemblies of the system 200. For example, as illustrated in FIG. 2, the power generation module 202 may be operatively coupled with the control module 204 via line 240 and configured to generate electrical energy to operate the control module 204. In another example, the power generation module 202 may be operatively coupled with the driver 142 of the compression assembly 118 via line 242, and configured to deliver electrical power thereto to drive the compression assembly 118.

The power generation system 202 may include an internal combustion engine 218 and a generator 220 operatively coupled with the internal combustion engine 218. In at least one embodiment, the internal combustion engine 218 may be fluidly coupled with the natural gas source 102 and configured to receive and combust at least a portion of the natural gas from the natural gas source 102 to generate mechanical energy. In another embodiment, the internal combustion engine 218 may be fluidly coupled with another component or assembly of the system 200 and configured to receive and combust the natural gas therefrom to generate mechanical energy. For example, as illustrated in FIG. 2, the internal combustion engine 218 may receive a regeneration gas from the separator 216 via line 238 and combust the regeneration gas to generate the mechanical energy. The generator 220 may be configured to convert the mechanical energy from the internal combustion engine 218 to electrical energy. The electrical energy from the generator 220 may be directed to the control module 204 and/or the compression assembly 118 via line 240 and/or line 242, respectively.

The control module 204 may be operatively coupled with one or more components, modules, systems, and/or assemblies of the system 200, and configured to monitor and/or control the components, modules, systems, and/or assemblies. For example, the control module 204 may include a controller 222 operatively and/or communicably coupled (e.g., wired or wirelessly) with the flash recovery module 210, the power generation module 202, the precompression module 206, the conditioning module 208, the liquefaction module 104, and/or components thereof. In an exemplary embodiment, the controller 222 may be configured to control a flow of the process fluid through the system 200 and/or one or more components thereof. For example, the controller 222 may be configured to control the inlet pressure and/or flow of the process fluid through one or more portions of the liquefaction module 104. In another example, the controller 222 may be configured to control the inlet pressure and/or flow of the process fluid through the liquefaction stream and/or the product stream of the liquefaction module 104.

The flash recovery module 210 may be fluidly coupled with and disposed downstream from the conditioning module 216 via line 244. The flash recovery module 210 may also be fluidly coupled with and disposed upstream of the liquefaction module 104 via line 248. The flash recovery module 210 may include one or more heat exchangers (one is shown 224) configured to receive and cool the natural gas in the process fluid flowing therethrough. For example, the heat exchanger 224 may be configured to receive and cool the natural gas contained in the process fluid from the conditioning module 208. As further described herein, the flash recovery module 210 and/or the heat exchanger 224 thereof may be configured to recover energy or work utilized to cool the natural gas to the LNG to thereby increase the efficiency of the system 200.

As illustrated in FIG. 2, the cooling assembly 112 of the liquefaction module 104 may include one or more pre-cooling heat exchangers (three are shown 226, 228, 230) fluidly coupled with and/or in thermal communication with the chiller 130. For example, as illustrated in FIG. 2, a first pre-cooling heat exchanger 226, a second pre-cooling heat exchanger 228, and a third pre-cooling heat exchanger 230 may each be fluidly coupled with the chiller 130 via respective cooling lines 252 and respective return lines 254. The first pre-cooling heat exchanger 226 may be fluidly coupled with and disposed downstream from the inlet 108 via line 156, and the second pre-cooling heat exchanger 228 may be fluidly coupled with and disposed downstream from the first pre-cooling heat exchanger 226 via line 256. The third pre-cooling heat exchanger 230 may be fluidly coupled with and disposed downstream from the compression assembly 118 via line 154, and may further be fluidly coupled with and disposed upstream of the second heat exchanger 116 via line 160. The pre-cooling heat exchangers 226, 228, 230 may be or include any device capable of at least partially cooling the process fluid flowing therethrough. Illustrative pre-cooling heat exchangers 226, 228, 230 may include, but are not limited to, a direct contact heat exchanger, a cooler, a trim cooler, a mechanical refrigeration unit, or the like, or any combination thereof.

In an exemplary operation of the system 200, the precompression module 206 may be configured to receive a process fluid containing the natural gas in the gaseous phase and compress the process fluid to the designed inlet pressure of the liquefaction module 104. For example, as previously discussed with reference to FIG. 1, the liquefaction module 104 may be configured to receive the process fluid at the inlet 108 thereof at a predetermined inlet pressure (e.g., about 1,000 kPa to about 8,400 kPa), and the natural gas source 102 may contain the natural gas at a pressure relatively lower than the predetermined inlet pressure of the liquefaction module 104. Accordingly, the compressor 212 of the precompression module 206 may be configured to receive the process fluid from the natural gas source 102 via line 232, compress the process fluid to the predetermined inlet pressure of the liquefaction module 104, and direct the compressed process fluid to the cooler 214 via line 246. As further described herein, the predetermined inlet pressure may determine, at least in part, the amount of the LNG produced in the system 200. The compressor 212 may also be configured to compress the process fluid to the predetermined separation pressure of the separator 216.

The compressed process fluid from the compressor 212 may be directed to the cooler 214 via line 246 and subsequently cooled therein. The cooler 214 may absorb at least a portion of the heat in the compressed process fluid and direct the cooled process fluid to the conditioning module 218 via line 234. In at least one embodiment, the cooler 214 may be configured to receive a heat transfer medium (e.g., water, steam, a refrigerant, a process gas, etc.) to absorb the heat in the process fluid flowing therethrough. For example, the heat transfer medium may be or include a refrigerant from the chiller 130. In another example, the heat transfer medium may be or include the vapor phase from the second liquid separator 122.

The process fluid from the precompression module 206 may then be directed to the conditioning module 208 via line 234. The separator 216 of the conditioning module 208 may remove at least a portion of the non-hydrocarbons from the natural gas contained in the process fluid to increase the concentration of the hydrocarbons in the process fluid. For example, the non-hydrocarbons in the process fluid flowing through the separator 216 may be adsorbed into the adsorbent contained in the separator 216. Removing the non-hydrocarbons, such as water and/or carbon dioxide, from the process fluid may prevent the natural gas in the process fluid from subsequently crystallizing (e.g., freezing) in one or more portions and/or downstream processes of the system 200. For example, the liquefaction module 104 may cool the process fluid to or below a freezing point of one or more of the non-hydrocarbons (e.g., water and/or carbon dioxide). Accordingly, removing water and/or carbon dioxide from the natural gas contained in the process fluid may prevent the subsequent freezing or crystallization of the process fluid in the liquefaction module 104.

The non-hydrocarbons adsorbed to the adsorbent may be desorbed from the adsorbent by directing or flowing a purge gas through the separator 216 to thereby regenerate the separator 216 and/or the adsorbent. As the purge gas flows through the separator 216, the non-hydrocarbons may desorb from the adsorbent and combine with the purge gas, thereby producing a regeneration gas including a mixture of the purge gas and the non-hydrocarbons. In an exemplary embodiment, the regeneration gas may contain a mixture of the purge gas, carbon dioxide, and/or water. The regeneration gas may be utilized as fuel for one or more processes or components of the system 200. For example, as illustrated in FIG. 1, the regeneration gas from the separator 216 of the conditioning module 208 may be directed to the internal combustion engine 218 of the power generation module 202 via line 238 and combusted as fuel (e.g., supplemental fuel) therein.

As illustrated in FIG. 2, at least a portion of the process fluid from the conditioning module 208 may be directed to the inlet 108 of the liquefaction module 104 via line 236. As further illustrated in FIG. 2, at least a portion of the process fluid from the conditioning module 208 may also be directed to the flash recovery module 210 via line 244. The liquefaction module 104 may be configured to receive the process fluid at the inlet 108 thereof, direct the process fluid through the product stream to cool at least a portion of the natural gas in the process fluid to the LNG, and discharge or output the process fluid containing the LNG through the outlet 110 thereof. In the product stream, the process fluid from the inlet 108 may be directed to the cooling assembly 112 and subsequently cooled therein. For example, as illustrated in FIG. 2, the process fluid from the inlet 108 may be directed to and through the first and second pre-cooling heat exchangers 226, 228 of the cooling assembly 112 and subsequently cooled therein. As previously discussed, the first and second pre-cooling heat exchangers 226, 228 may receive a refrigerant from the chiller 130 via the respective cooling lines 252, and transfer the heat from the process fluid flowing therethrough to the refrigerant to thereby cool the process fluid.

The process fluid from the cooling assembly 112 may then be directed to the first heat exchanger 114 via line 158. The first heat exchanger 114 may further cool the process fluid from the cooling assembly 112 and direct the cooled process fluid to the expansion valve 126 via line 172. The expansion valve 126 may receive the process fluid from the first heat exchanger 114 via line 172 and expand the process fluid to line 190. The expansion of the process fluid through the expansion valve 126 may flash the process fluid into a two-phase fluid including a vapor phase (e.g., flash gas) and a liquid phase or the LNG. The two-phase fluid may be directed to the second liquid separator 122 where the LNG and the vapor phase may be separated from one another. The LNG separated in the second liquid separator 122 may then be directed to the storage tank 106 via the outlet 110. The vapor phase separated in the second liquid separator 112 may be discharged from the outlet 148 of the liquefaction module 104 via line 192.

In at least one embodiment, the vapor phase from the second liquid separator 122 may be combined with the process fluid flowing through one or more portions of the core-module 104. For example, the vapor phase from the second liquid separator 122 may be combined with the process fluid flowing through the liquefaction stream and/or the product stream. In another embodiment, the vapor phase from the second liquid separator 122 may be directed to one or more of the heat exchangers and/or coolers of the system 200. For example, the vapor phase may be directed to one or more of the coolers 144, 146 of the compression assembly 118 to cool the process fluid flowing therethrough.

In yet another embodiment, the vapor phase discharged from the outlet 148 of the liquefaction module 104 may be directed to one or more of the modules 202, 204, 206, 208, 210 of the system 200 via line 258. For example, as illustrated in FIG. 1, the vapor phase discharged from the outlet 148 may be directed to the power generation module 202 via line 262 to provide supplemental fuel to the internal combustion engine 218. In yet another example, the vapor phase discharged from the outlet 148 may be directed to the precompression module 206 via line 264. In another example, illustrated in FIG. 1, the vapor phase (e.g., flash gas) discharged from the outlet 148 may be directed to the heat exchanger 224 of the flash recovery module 210 via line 258 and line 260. The heat exchanger 224 of the flash recovery module 210 may receive at least a portion of the process fluid containing natural gas from the conditioning module 208 via line 244, transfer heat from the process fluid to the vapor phase to cool the process fluid, and direct the cooled process fluid to the liquefaction module 104 via line 248. It should be appreciated that cooling the process fluid with the vapor phase (e.g., flash gas) in the flash recovery module 210 may recover energy or work utilized to cool the natural gas to the LNG in the liquefaction module 104, thereby increasing the efficiency of the system 200.

The cooled process fluid from the flash recovery module 210 may be directed to any portion of the liquefaction module 104. For example, the cooled process fluid from the flash recovery module 210 may be combined with the process fluid flowing through the liquefaction stream and/or the product stream. In an exemplary embodiment, the cooled process fluid from the flash recovery module 210 may be directed to the liquefaction module 104 downstream the first heat exchanger 114. For example, as illustrated in FIG. 2, the cooled process fluid from the flash recovery module 210 may be directed to line 172 downstream from the first heat exchanger 114 via line 248 and combined with the process fluid flowing therethrough. In another example, the cooled process fluid from the flash recovery module 210 may be directed to the liquefaction module 104 upstream of the first heat exchanger 114.

The heated or "spent" vapor phase from the heat exchanger 224 of the flash recovery module 210 may be directed to any portion or module of the system 200 including the liquefaction module 104, the power generation module 202, the precompression module 206, the conditioning module 208, or any combination thereof. For example, the vapor phase from the flash recovery module 210 may be combined with the process fluid flowing through the liquefaction stream and or the product stream of the liquefaction module 104. In another example, the vapor phase from the flash recovery module 210 may be directed to one or more of the heat exchangers and/or coolers of the system 200. In yet another example, illustrated in FIG. 2, the vapor phase from the flash recovery module 210 may be directed to the power generation module 202 and/or the precompression module 206 via line 262 and/or line 264, respectively.

Figure 3:
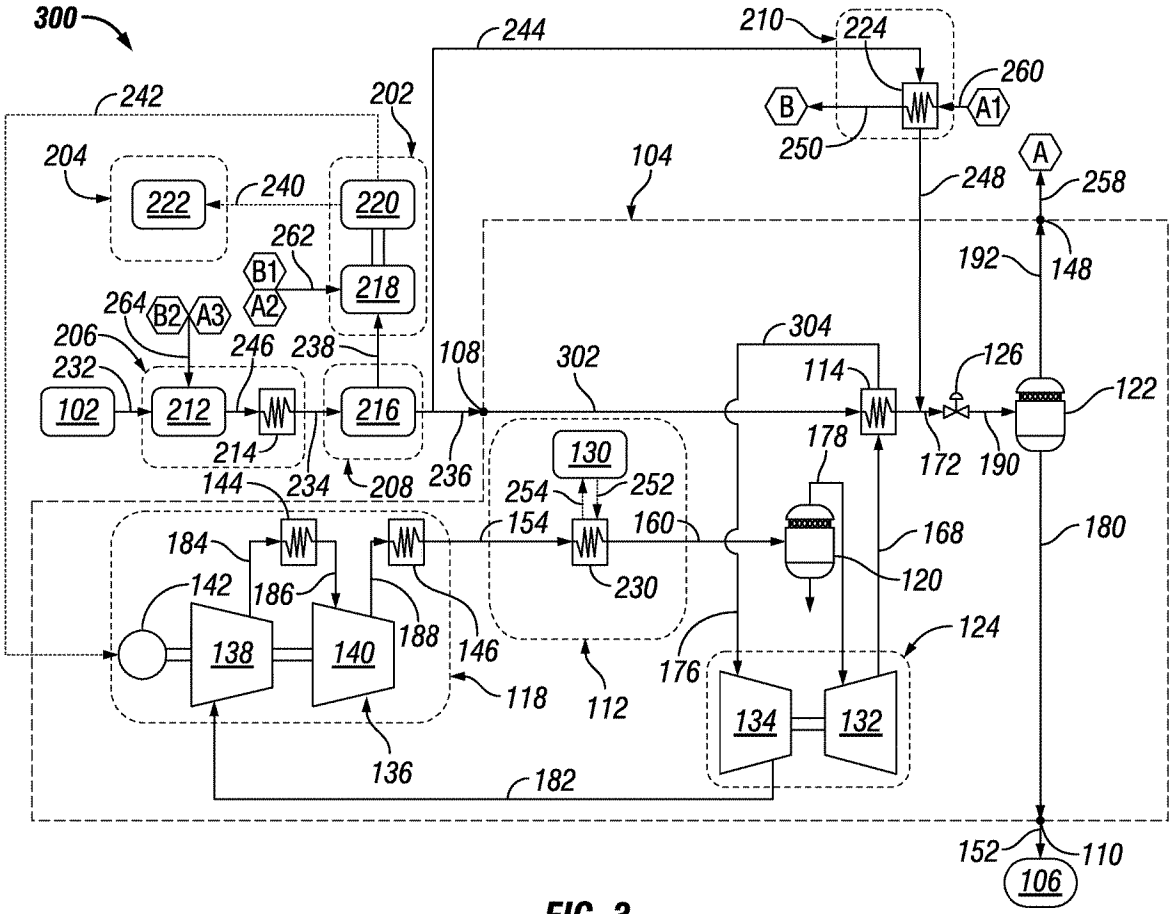
FIG. 3 illustrates a process flow diagram of another exemplary system for producing liquefied natural gas from a natural gas source, according to one or more embodiments disclosed.

FIG. 3 illustrates a process flow diagram of another exemplary system 300 for producing the LNG from the natural gas source 102, according to one or more embodiments. The system 300 illustrated in FIG. 3 may be similar in some respects to the systems 100, 200 described above and therefore may be best understood with reference to the description of FIGS. 1 and 2, where like numerals designate like components and will not be described again in detail. As illustrated in FIG. 3, the cooling assembly 112 of the liquefaction module 104 may include a single pre-cooling heat exchanger 230 fluidly coupled with and in thermal communication with the chiller 130. The cooling assembly 112 may be configured to cool the process fluid flowing through the liquefaction stream of the liquefaction module 104. In an exemplary embodiment, the cooling assembly 112 and the pre-cooling heat exchanger 230 thereof may not be utilized to cool or precool the process fluid flowing through the product stream. For example, the cooling assembly 112 and the pre-cooling heat exchanger 230 thereof may not be utilized to cool the process fluid flowing through the product stream from the inlet 108 to the outlet 110 of the liquefaction module 104. In another embodiment, the process fluid from the pre-cooling heat exchanger 230 of the cooling assembly 112 may also not be cooled or precooled by the process fluid (e.g., the refrigeration stream) flowing to the compressor 134 of the turbo-expander 124. For example, the refrigeration stream from the first heat exchanger 114 may not cool or precool the process fluid from the pre-cooling heat exchanger 230 of the cooling assembly 112. In at least one embodiment, illustrated in FIG. 3, the pre-cooling heat exchanger 230 may be fluidly coupled with and disposed upstream of the first liquid separator 120 via line 160. In another embodiment, the first liquid separator 120 may be omitted and the pre-cooling heat exchanger 230 may be fluidly coupled with and disposed upstream of the turbine 132 of the turbo-expander 124.

In an exemplary operation, the liquefaction module 104 may be configured to receive a process fluid containing the natural gas in the gaseous phase at the inlet 108 thereof, direct or flow the process fluid containing the natural gas in the gaseous phase through the product stream to cool at least a portion of the natural gas in the process fluid to the LNG, and discharge the process fluid containing the LNG through the outlet 110 thereof. The liquefaction module 104 may also be configured to circulate a process fluid containing natural gas through a liquefaction stream to cool at least a portion of the process fluid flowing through the product stream.

In the product stream illustrated in FIG. 3, the process fluid containing the natural gas in the gaseous phase may flow directly from the inlet 108 to the first heat exchanger 114 via line 302. Accordingly, in an exemplary embodiment, the process fluid from the inlet 108 may not be cooled in the cooling assembly 112 of the liquefaction module 104. The first heat exchanger 114 may cool the process fluid from the inlet 108 and direct the cooled process fluid to the expansion valve 126 via line 172. The refrigeration stream from the turbine 132 may be directed to the first heat exchanger 114 via line 168 to cool the process fluid flowing through the product stream from line 302 to line 172. The expansion valve 126 may receive the process fluid from the first heat exchanger 114 via line 172, expand the process fluid to decrease the temperature and pressure of the process fluid, and output the expanded process fluid to line 190. As previously discussed, the expansion of the process fluid through the expansion valve 126 may flash the process fluid into a two-phase fluid including a gaseous phase and a liquid phase. The second liquid separator 122 may separate at least a portion of the LNG from the vapor phase, and direct the LNG to the storage tank 106 via the outlet 110.

In the liquefaction stream, the process fluid containing the natural gas may be directed to the compression assembly 118 and subsequently compressed therein. In an exemplary embodiment, the compression assembly 118 may compress the process fluid to a pressure of at least about 7,000 kPa. For example, the compression assembly 118 may compress the process fluid to a pressure from about 7,000 kPa, about 7,300 kPa, about 7,600 kPa, about 7,900 kPa, or about 8,200 kPa to about 8,500 kPa, about 8,800 kPa, about 9,100 kPa, about 9,400 kPa, about 9,700 kPa, about 10,000 kPa, or greater. In another example, the compression assembly 118 may compress the process fluid to a pressure from about 7,000 kPa to about 10,000 kPa, from about 7,300 kPa to about 9,700 kPa, from about 7,600 kPa to about 9,400 kPa, from about 7,900 kPa to about 9,100 kPa, or from about 8,200 kPa to about 8,500 kPa.

The compressed process fluid from the compression assembly 118 may be directed to the pre-cooling heat exchanger 230 of the cooling assembly 112 via line 154 and subsequently cooled therein. In at least one embodiment, the cooled process fluid in the liquefaction stream may flow directly from the pre-cooling heat exchanger 230 of the cooling assembly 112 to the turbine 132 of the turbo-expander 124. In another embodiment, illustrated in FIG. 3, the cooled process fluid in the liquefaction stream may flow directly from the pre-cooling heat exchanger 230 of the cooling assembly 112 to the first liquid separator 120. For example, as illustrated in FIG. 3, the pre-cooling heat exchanger 230 of the cooling assembly 112 may be fluidly coupled with and disposed upstream of the first liquid separator 120 via line 160. The pre-cooling heat exchanger 230 may cool at least a portion of the natural gas contained in the process fluid to a liquid phase (e.g., the natural gas liquids and/or the LNG).

The first liquid separator 120 may receive the process fluid from the cooling assembly 112 and remove or separate at least a portion of the NGLs from the process fluid to thereby provide a relatively drier process fluid. The relatively drier process fluid from the first liquid separator 120 may be expanded through the turbine 132 to decrease the temperature and pressure thereof and thereby generate the refrigeration stream in line 168. The refrigeration stream in line 168 may have a temperature of about −50° C., about −75° C., about −100° C., about −125° C., or lower. For example, the temperature of the refrigeration stream in line 168 may be less than about −50° C., less than about −75° C., less than about −85° C., less than about −95° C., less than about −100° C., less than about −105° C., less than about −110° C., less than about −115° C., less than about −120° C., less than about −125° C., less than about −130° C., or less than about −140° C. The refrigeration stream in line 168 may have a pressure less than about 2,200 kPa, less than about 2,000 kPa, less than about 1,800 kPa, less than about 1,500 kPa, less than about 1,200 kPa, less than about 1,000 kPa, less than about 900 kPa, less than about 800 kPa, less than about 700 kPa, or less than about 600 kPa. The refrigeration stream from the turbine 132 may be directed to the first heat exchanger 114 via line 168 to absorb the heat from the process fluid flowing through the product stream from line 302 to line 172.

In the system 300 illustrated in FIG. 3, the refrigeration stream from the first heat exchanger 114 may not be utilized to cool or pre-cool the process fluid from the cooling assembly 112. For example, as illustrated in FIG. 3, the refrigeration stream from the first heat exchanger 114 may flow directly to the compressor 134 of the turbo-expander 124 via line 304 and be compressed therein. The compressor 134 may be configured to receive the refrigeration stream from the first heat exchanger 116, compress the refrigeration stream, and direct the compressed refrigeration stream to the compression assembly 118 as a recycle stream via line 182. The compressor 134 may compress the refrigeration stream to a pressure of greater than about 900 kPa, greater than about 1,000 kPa, greater than about 1,100 kPa, greater than about 1,200 kPa, greater than about 1,300 kPa, greater than about 1,400 kPa, greater than about 1,500 kPa, greater than about 1,600 kPa, greater than about 1,700 kPa, greater than about 1,800 kPa, or greater than about 1,900 kPa. The compression assembly 118 may receive the recycle stream and direct the recycle stream through the liquefaction stream, as described above.

Figure 4:
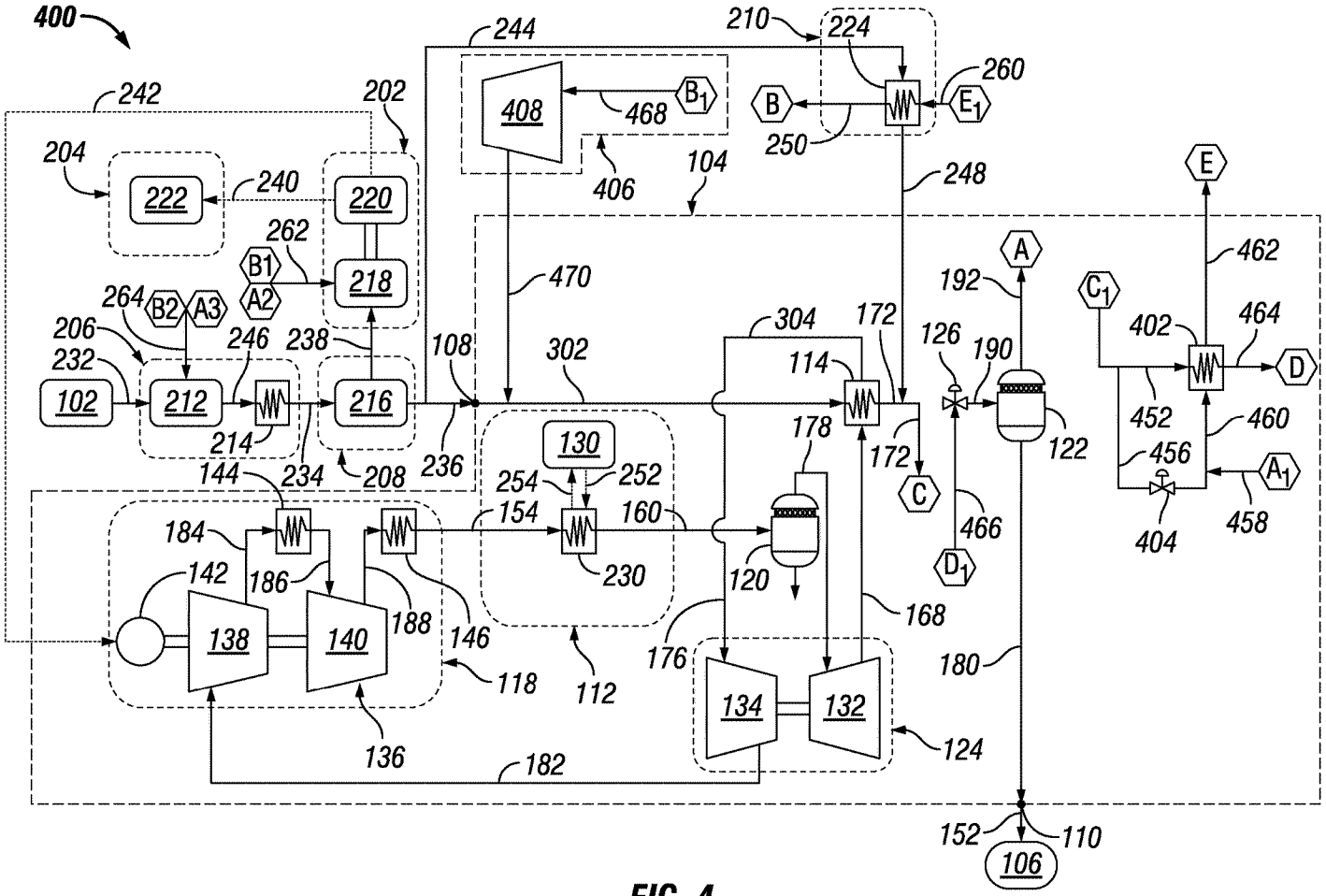
FIG. 4 illustrates a process flow diagram of another exemplary system for producing liquefied natural gas from a natural gas source, according to one or more embodiments disclosed.

FIG. 4 illustrates a process flow diagram of another exemplary system 400 for producing the LNG from the natural gas source 102, according to one or more embodiments. The system 400 illustrated in FIG. 4 may be similar in some respects to the systems 100, 200, 300 described above and therefore may be best understood with reference to the description of FIGS. 1-3, where like numerals designate like components and will not be described again in detail. As illustrated in FIG. 4, the liquefaction module 104 of the system 400 may further include an additional heat exchanger 402 and/or an additional expansion valve 404. The additional heat exchanger 402 and/or the additional expansion valve 404 may be fluidly coupled with and disposed downstream from the first heat exchanger 114. For example, as illustrated in FIG. 4, the heat exchanger 402 may be fluidly coupled with and disposed downstream from the first heat exchanger 114 via lines 172 and 452, and the expansion valve 404 may be fluidly coupled with and disposed downstream from the first heat exchanger 114 via lines 172, 452, and 456. The heat exchanger 402 and/or the expansion valve 404 may also be fluidly coupled with and disposed downstream from the heat exchanger 224 of the flash recovery module 210. For example, as illustrated in FIG. 4, the heat exchanger 402 may be fluidly coupled with and disposed downstream from the heat exchanger 224 of the flash recovery module 210 via lines 248, 172, and 452. In another example, the expansion valve 404 may be fluidly coupled with and disposed downstream from the heat exchanger 224 of the flash recovery module 210 via lines 248, 172, 452, and 456.

As further illustrated in FIG. 4, the heat exchanger 402 may be fluidly coupled with and disposed downstream from the expansion valve 404 and/or the second liquid separator 122. For example, the heat exchanger 402 may be fluidly coupled with and disposed downstream from the expansion valve 404 via line 460. In another example, the heat exchanger 402 may be fluidly coupled with and disposed downstream from the second liquid separator 122 via lines 192, 458, and 460. The heat exchanger 402 may also be fluidly coupled with and disposed upstream of the expansion valve 126 and/or the flash recovery module 210. For example, as illustrated in FIG. 4, the heat exchanger 402 may be fluidly coupled with and disposed upstream of the expansion valve 126 via lines 464 and 466. In another example, the heat exchanger 402 may be fluidly coupled with and disposed upstream of the flash recovery module 210 via lines 462 and 260. As further described herein, the heat exchanger 402 may be configured to receive the process fluid from the first heat exchanger 114 and cool the process fluid from the first heat exchanger 114 with the process fluid from the expansion valve 404. The heat exchanger 402 may also be configured to direct the cooled process fluid to the expansion valve 126 via lines 464 and 466, and may further be configured to direct the heated process fluid to the flash recovery module 210 via lines 462 and 260.

As illustrated in FIG. 4, the system 400 may include a compressor module 406 fluidly and/or operatively coupled with the flash recovery module 210. For example, as illustrated in FIG. 4, the compressor module 406 may be fluidly coupled with and disposed downstream from the flash recovery module 210 via lines 250 and 468. The compression module 406 may include a compressor 408 configured to receive the process fluid from the heat exchanger 224 of the flash recovery module 210, compress the process fluid, and direct the compressed process fluid to the liquefaction module 104. The compressor 408 may be configured to direct the compressed process fluid to the liquefaction module 104 upstream of the first heat exchanger 114 via line 470.

As illustrated in FIG. 4, the cooling assembly 112 of the liquefaction module 104 may include a single pre-cooling heat exchanger 230 fluidly coupled with and in thermal communication with the chiller 130. The cooling assembly 112 may be configured to cool the process fluid flowing through the liquefaction stream of the liquefaction module 104. In an exemplary embodiment, the cooling assembly 112 and the pre-cooling heat exchanger 230 thereof may not be utilized to cool or precool the process fluid flowing through the product stream. For example, the cooling assembly 112 and the pre-cooling heat exchanger 230 thereof may not be utilized to cool the process fluid flowing through the product stream from the inlet 108 to the outlet 110 of the liquefaction module 104. In another embodiment, the process fluid from the pre-cooling heat exchanger 230 of the cooling assembly 112 may also not be cooled or precooled by the process fluid (e.g., the refrigeration stream) flowing to the compressor 134 of the turbo-expander 124. For example, the refrigeration stream from the first heat exchanger 114 may not cool or precool the process fluid from the pre-cooling heat exchanger 230 of the cooling assembly 112.

In an exemplary operation, with continued reference to FIG. 4, the liquefaction module 104 may be configured to receive a process fluid containing natural gas in the gaseous phase at the inlet 108 thereof, direct or flow the process fluid containing the natural gas in the gaseous phase through the product stream to cool at least a portion of the natural gas in the process fluid to the LNG, and discharge the process fluid containing the LNG through the outlet 110 thereof. The liquefaction module 104 may also be configured to circulate a process fluid containing natural gas through a liquefaction stream to cool at least a portion of the process fluid flowing through the product stream.

In the product stream illustrated in FIG. 4, the process fluid containing the natural gas in the gaseous phase may flow directly from the inlet 108 to the first heat exchanger 114 via line 302. The first heat exchanger 114 may cool the process fluid from the inlet 108 and direct the cooled process fluid to the additional heat exchanger 402 and/or the expansion valve 404. The refrigeration stream from the turbine 132 may be directed to the first heat exchanger 114 via line 168 to cool the process fluid flowing through the product stream from line 302 to line 172. In an exemplary embodiment, at least a portion of the process fluid from the first heat exchanger 114 may be directed to the heat exchanger 402, and at least a portion of the process fluid from the first heat exchanger 114 may be directed to the expansion valve 404. The expansion valve 404 may receive the process fluid from the first heat exchanger 114 via lines 172, 452, and 456, expand the process fluid to decrease the temperature and pressure thereof, and output the expanded process fluid to line 460. The expansion of the process fluid through the expansion valve 404 may flash at least a portion of the process fluid into a two-phase fluid including a gaseous phase and a liquid phase. The expanded process fluid in line 460 may be directed to the heat exchanger 402 to cool the process fluid flowing therethrough. The cooled process fluid from the heat exchanger 402 may then be directed to the expansion valve 126 via line 464, 466, and the spent process fluid may flow to the flash recovery module 210 via lines 462 and 260. The process fluid directed to the expansion valve 126 may be expanded through the expansion valve 126 into a two-phase fluid, and the second liquid separator 122 may separate at least a portion of the LNG from the vapor phase, and direct the LNG to the storage tank 106 via the outlet 110. The process fluid directed to the flash recovery module 210 may flow through the heat exchanger 224 to cool the process fluid flowing therethrough from line 244 to line 248. The process fluid may then be discharged from the heat exchanger 224 and directed to the compressor 408 of the compression module 406. The compressor 408 may compress the process fluid and direct the process fluid to the liquefaction assembly 104 via line 470.

The inlet pressure and/or flow of the process fluid through the product stream of the systems 100, 200, 300, 400 illustrated in FIGS. 1-4 may at least partially determine the amount of the LNG produced in the respective systems 100, 200, 300, 400. In an exemplary embodiment, the pressure of the process fluid at the inlet 108 (e.g., the inlet pressure) of the liquefaction module 104 may at least partially determine the amount of the LNG produced in each of the systems 100, 200, 300, 400. For example, the pressure of the process fluid at the inlet 108 may be increased to correspondingly increase the amount of the LNG produced. In another example, the pressure of the process fluid at the inlet 108 may be decreased to correspondingly decrease the amount of the LNG produced. Accordingly, it may be appreciated that the precompression assembly 206 may be configured to increase or decrease the amount of the LNG produced by increasing or decreasing the pressure of the process fluid directed to the inlet 108 of the liquefaction module 104.

The pressure and/or the flow of the process fluid through one or more portions of the liquefaction stream may also determine, at least in part, the amount of the LNG produced in each of the systems 100, 200, 300, 400. For example, the pressure and/or the flow of the process fluid through one or more portions of the liquefaction stream may at least partially determine the amount or degree of cooling provided to the process fluid flowing through the product stream. In at least one embodiment, increasing the pressure and/or the flow of the process fluid through the liquefaction stream may correspondingly increase the cooling provided to the process fluid flowing through the product stream. For example, increasing the pressure and/or the flow of the process fluid to the turbine 132 of the turbo-expander 124 may increase refrigeration. In another example, increasing the pressure of the process fluid may increase volumetric or volume flow through the turbine 132. In yet another example, increasing the pressure and/or the flow of the process fluid to the turbine 132 of the turbo-expander 124 may decrease the temperature of the refrigeration stream directed to the first heat exchanger 114 and thereby increase the cooling or refrigeration provided to the process fluid flowing through the product stream.

Figure 5:
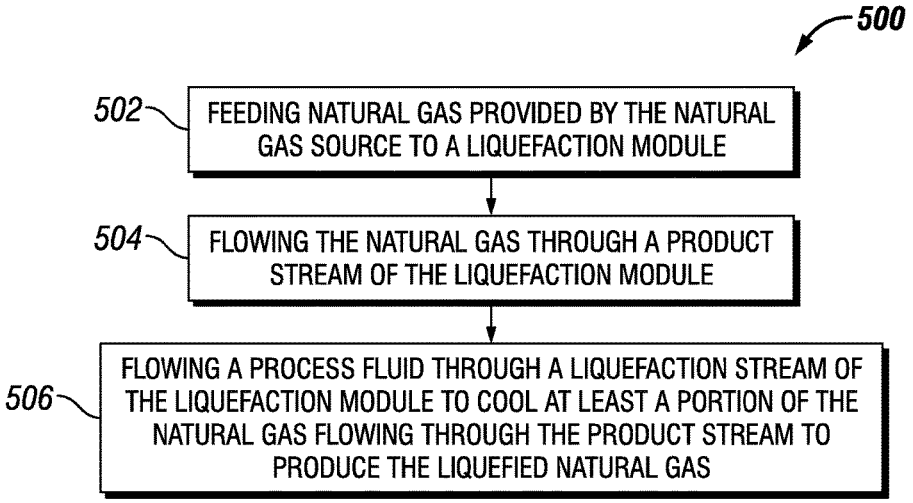
FIG. 5 illustrates a flowchart of a method for producing liquefied natural gas from a natural gas source, according to one or more embodiments disclosed.

FIG. 5 illustrates a flowchart of a method 400 for producing liquefied natural gas from a natural gas source, according to one or more embodiments. The method 500 may include feeding natural gas provided by the natural gas source to a liquefaction module, as shown at 502. The method 500 may also include flowing the natural gas through a product stream of the liquefaction module, as shown at 504. The method 500 may further include flowing a process fluid through a liquefaction stream of the liquefaction module to cool at least a portion of the natural gas flowing through the product stream to produce the liquefied natural gas, as shown at 506.

Figure 6:
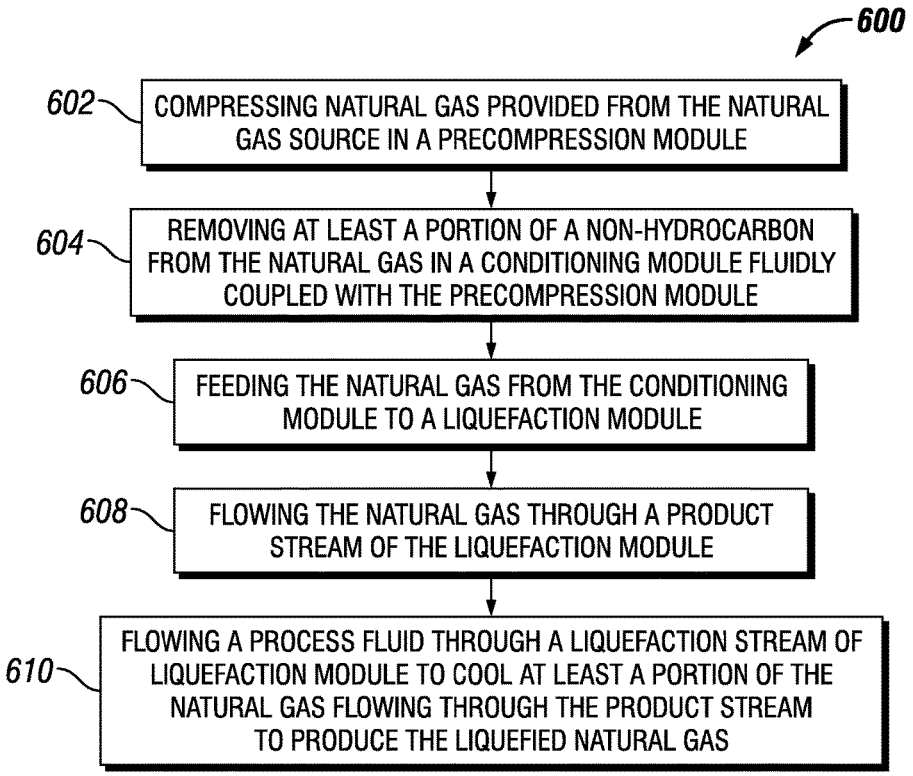
FIG. 6 illustrates a flowchart of another method for producing liquefied natural gas from a natural gas source, according to one or more embodiments disclosed.

FIG. 6 illustrates a flowchart of another method 600 for producing liquefied natural gas from a natural gas source, according to one or more embodiments. The method 600 may include compressing natural gas provided from the natural gas source in a precompression module, as shown at 602. The method 600 may also include removing at least a portion of a non-hydrocarbon from the natural gas in a conditioning module fluidly coupled with the precompression module, as shown at 604. The method 600 may further include feeding the natural gas from the conditioning module to a liquefaction module, as shown at 606. The method 600 may also include flowing the natural gas through a product stream of the liquefaction module, as shown at 608. The method 600 may also include flowing a process fluid through a liquefaction stream of the liquefaction module to cool at least a portion of the natural gas flowing through the product stream to produce the liquefied natural gas, as shown at 610.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure. Additionally, all numerical values are "about" or "approximately" the indicated value, and take into account experimental error and variations that would be expected by a person having ordinary skill in the art. It should be appreciated that all numerical values and ranges disclosed herein are approximate valves and ranges, whether "about" is used in conjunction therewith. It should also be appreciated that the term "about," as used herein, in conjunction with a numeral refers to a value that may be +/−1% (inclusive) of that numeral, +/−2% (inclusive) of that numeral, +/−3% (inclusive) of that numeral, +/−5% (inclusive) of that numeral, +/−10% (inclusive) of that numeral, or +/−15% (inclusive) of that numeral. It should further be appreciated that when a numerical range is disclosed herein, any numerical value falling within the range is also specifically disclosed.

We claim:

1. A method for producing liquefied natural gas from a natural gas source, comprising:

feeding natural gas provided by the natural gas source to a precompression module;

controlling the precompression module to increase or decrease an amount of the liquefied natural gas to be produced by the method based at least in part on a level of pressure imparted by the precompression module to the natural gas fed into the precompression module;

directing the natural gas from the precompression module to a product stream of the liquefaction module, wherein the directing of the natural gas to the product stream of the liquefaction module comprises:

cooling the natural gas in a pre-cooling heat exchanger of a cooling assembly;

further cooling the cooled natural gas from the cooling assembly in a first heat exchanger of a pair of heat exchangers downstream from the cooling assembly;

expanding the further cooled natural gas from the first heat exchanger of the pair of heat exchangers downstream from the cooling assembly in an expansion valve to produce a two-phase fluid including liquefied natural gas and a vapor phase; and separating the liquefied natural gas from the vapor phase in a liquid separator of the liquefaction module; and directing a process fluid to a liquefaction stream of the liquefaction module to cool at least a portion of the natural gas directed to the product stream, wherein the directing of the process fluid to the liquefaction stream of the liquefaction module comprises:

compressing the process fluid in a compression assembly;

cooling the compressed process fluid in another heat exchanger of the cooling assembly;

further cooling the cooled, compressed process fluid in a second heat exchanger of the pair of heat exchangers;

at least partially separating natural gas liquids from the further cooled, compressed process fluid from the second heat exchanger of the pair of heat exchangers in a liquid separator to form at least a further cooled, compressed process vapor;

expanding the further cooled, compressed process vapor in a turbine of a turbomachinery to generate a refrigeration stream; and cooling the at least a portion of the natural gas directed to the product stream with the refrigeration stream.

2. The method of claim 1, further comprising storing the liquefied natural gas in a storage tank fluidly coupled with the liquefaction module.

3. The method of claim 2, further comprising:

feeding the vapor phase from the liquid separator of the liquefaction module to a flash recovery module fluidly coupled with the liquefaction module; and cooling at least a portion of natural gas from the precompression module in the flash recovery module with the vapor phase.

4. The method of claim 2, wherein the directing of the process fluid to the liquefaction stream of the liquefaction module further comprises:

compressing the refrigeration stream in a compressor of the turbomachinery to produce a recycle stream; and compressing the recycle stream in the compression assembly.

5. The method of claim 2, further comprising:

generating electrical energy in a power generation module;

delivering the electrical energy from the power generation module to the liquefaction module; and driving the compression assembly of the liquefaction module with the electrical energy.

6. The method of claim 1, further comprising removing at least a portion of a non-hydrocarbon from the natural gas provided from the natural gas source in a conditioning module before feeding the natural gas provided from the natural gas source to the liquefaction module.

* * * * *